US006050901A

United States Patent [19]

Davis

[11] Patent Number: 6,050,901

[45] Date of Patent: Apr. 18, 2000

[54] MODULAR AND ADJUSTABLE PUTTING SURFACE

[76] Inventor: Grover Davis, 502 Second Ave., Auduban, Iowa 50025

[21] Appl. No.: 09/314,319

[22] Filed: May 19, 1999

[51] Int. Cl.[7] ..... A63B 69/36

[52] U.S. Cl. ..... 473/160

[58] Field of Search ..... 473/160, 161, 473/162, 278, 279

[56] References Cited

U.S. PATENT DOCUMENTS

| | | | |
|---|---|---|---|
| 1,612,291 | 2/1926 | Jackson . | |
| 3,522,947 | 8/1970 | Anderson et al. | 473/161 |
| 3,595,581 | 7/1971 | Anderson | 473/161 |
| 3,658,343 | 4/1972 | Rogers et al. | 473/161 |
| 4,240,637 | 12/1980 | Cross et al. . | |
| 5,441,265 | 8/1995 | Codlin . | |
| 5,516,109 | 5/1996 | Desjardins . | |
| 5,655,971 | 8/1997 | Wayne . | |

*Primary Examiner*—Mark S. Graham
*Attorney, Agent, or Firm*—Henderson & Sturm LLP

[57] ABSTRACT

A modular putting surface apparatus for creating an adjustable putting surface. Each module comprises a frame, a first and second end member, a center members and two surface members connecting the center member and the end members. The center member is adjustable up and down at each end to create a complex curved surface. Multiple independent support members allow the surface area to be sufficiently flexible so as to be adjustable and simultaneously rigid enough to support humans walking on the surface. Multiple modules are interconnected to for a larger putting surface. The entire surface area is covered with a cover material chosen for its putting characteristics so as to simulate putting on grass.

12 Claims, 5 Drawing Sheets

MODULAR AND ADJUSTABLE PUTTING SURFACE

CROSS-REFERENCE TO RELATED APPLICATIONS

Not applicable.

STATEMENT REGARDING FEDERALLY SPONSORED RESEARCH OR DEVELOPMENT

Not applicable.

MICROFICHE APPENDIX

Not applicable.

BACKGROUND OF THE INVENTION

1. Field of the Invention

This invention relates generally to an adjustable putting surface apparatus and more specifically to a putting surface which is modular and which is sufficiently flexible to be adjustable while being sufficiently rigid in order to support humans walking on said surface.

2. Description of Prior Art

There are various designs in the prior art for the construction of adjustable putting surfaces. However, the designs in the prior art are all limited in one or more of several ways. Of particular importance are the limitations regarding adjustability, modularity and the ability of the putting surface to support human weight. Regarding the adjustability, many designs allow for the putting surface to be adjustable. However, these designs are not readily adaptable for modular construction to fill a large area. Additionally, these adjustable putting surfaces are designed for support of a golf ball but are not designed to support the weight of humans walking on the putting surface. Consequently, there is a need for an adjustable and modular putting surface design which can support humans walking on the putting surface.

BRIEF SUMMARY OF THE INVENTION

The present invention relates generally to an adjustable putting surface apparatus and more specifically to a putting surface which is modular and which is sufficiently flexible to be adjustable while being sufficiently rigid in order to support humans walking on said surface. A modular putting surface apparatus of the present invention includes a frame. An end member is rigidly attached to said frame at each end. A center member is positioned between the two end members and is connected to the frame via one or more connecting mechanisms. In a preferred embodiment, at least one of the connecting mechanism comprises a lifting mechanism.

A first surface member is connected at one end to one of the end members and connected at the other end to the center member. A second surface member is connected at one end to the other end member and connected at the other end to the center member. A cover material is positioned over the top of the end members, the center member and the surface members. In a preferred embodiment the cover material selected is an artificial grass material. The material should be elastic enough to stretch and contract as the putting surface is adjusted. Additionally, the material should adequately simulate putting on natural grass.

In a preferred embodiment of the present invention, the connecting mechanism are positioned near the ends of the center member. The lifting mechanism comprises a screw jack which is connected to the frame and to the center member. The connections are such that certain amount of pivoting can occur while the position of the center member is being adjusted.

Connection of the surface members to the end members and the center member is accomplished utilizing a plurality of connectors. The connectors are selected to be sufficiently strong to provide the required support while also including some expansion capabilities. As will be described in greater detail below, these connectors can include double hinges and flexible straps. The flexible strap can be made out of a variety of materials.

In a preferred embodiment each of the surface members includes a flat portion and a series of support members. The support members function independently and are not connected. The ends of the support members are tapered to prevent binding while the surface is being adjusted.

Therefore it is an object of the present invention to provide an improved modular and adjustable putting surface.

It is a further object of the present invention to provide an improved modular and adjustable putting surface capable of supporting human weight.

It is still a further object of the present invention to provide an improved modular and adjustable putting surface of sufficient quality to be utilized both as a recreational device and as a training device.

Other objects, advantages, and novel features of the present invention will become apparent from the following detailed description of the invention when considered in conjunction with the accompanying drawings.

DETAILED DESCRIPTION OF THE INVENTION

Figure 1:
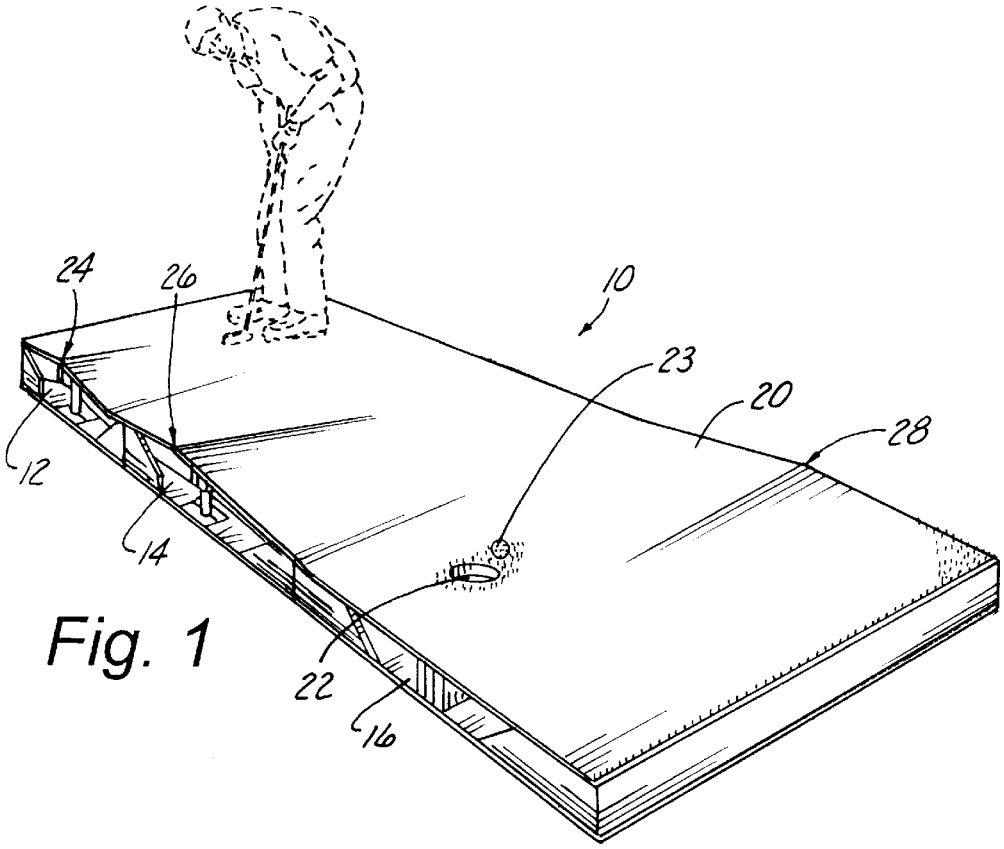
FIG. 1 is a perspective view of several adjustable putting surface modules built in accordance with the present invention.

Referring now to the drawings wherein like reference numerals designate identical or corresponding parts throughout the several views, FIG. 1 shows putting system (10) including a series of modular and adjustable putting surface sections (12, 14 and 16) connected and built in accordance with the present invention. The top surface is covered with a covering (20). The covering (20) is selected for its putting qualities and characteristics to simulate putting on grass. The covering (20) should include an elastic quality such that it can stretch and contract when the putting surface is adjusted.

In the putting system (10) as shown, the section (12) has been adjusted to have a small ridge (24). The section (14) includes a larger ridge (26) and the section (16) also include a ridge (28) on the opposite edge. If a section includes an adjustment mechanism, discussed below, on each edge, then both sides can be adjusted. A hole (22) is included in section (16) and serves as the target for the golf ball (23) putted by the golfer (shown in outline).

Figure 2:
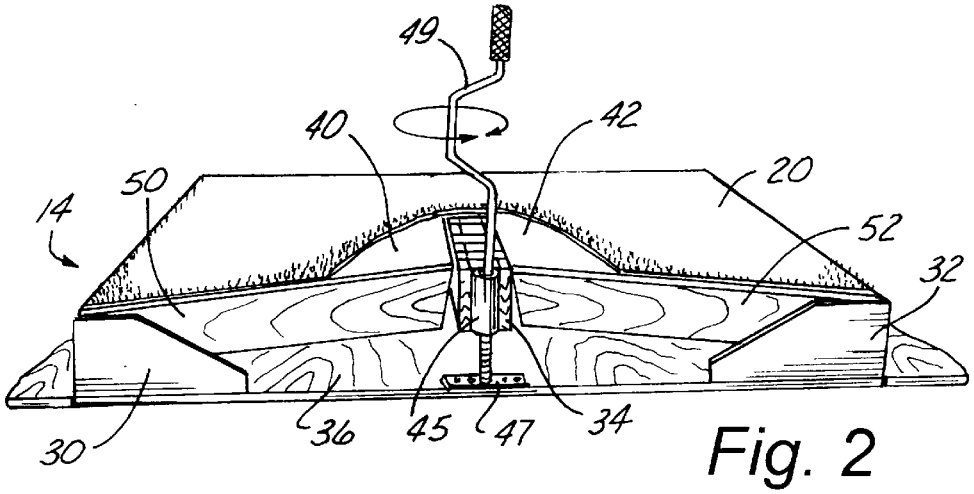
FIG. 2 is a partial side view demonstrating how a putting surface module of the present invention is adjusted.

Referring now to FIG. 2, the section (14) is shown exposing the fundamental lifting components of the present invention. The section (14) includes a first end member (30), a second end member (32) and a center member (34). The first end member (30) and the second end member (32) are positioned and connected on opposite ends of a base (36). A first surface member (40) is linked to the first end member (30) at one end and to the center member (34) at the other end. A second surface member (42) is linked to the second end member (32) at one end and to the center member (34) at the other end. The center member (34) is attached to the base (36) via a connection mechanism (45). The connection mechanism (45) is held in position with respect to the base (36) utilizing a bracket (47).

Figure 3:
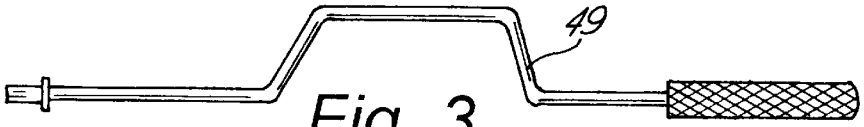
FIG. 3 is a side view of a crank arm used to adjust the modular putting surface.

In a preferred embodiment of the present invention, the connection mechanism (45) is a screw jack. The screw jack is adjustable utilizing a crank (49), shown in FIG. 3. The height of the end of the center member (34) is adjustable upwardly and downwardly by inserting the crank (49) in to the screw jack and rotating the crank (49) in one direction or the other. Support member (50) is shown supporting the first surface member (40). Similarly, support member (52) is shown supporting the second surface member (42).

Obviously, a variety of other connection mechanisms, including mechanism which are capable of lifting, could be used in accordance with the present invention.

Figure 4:
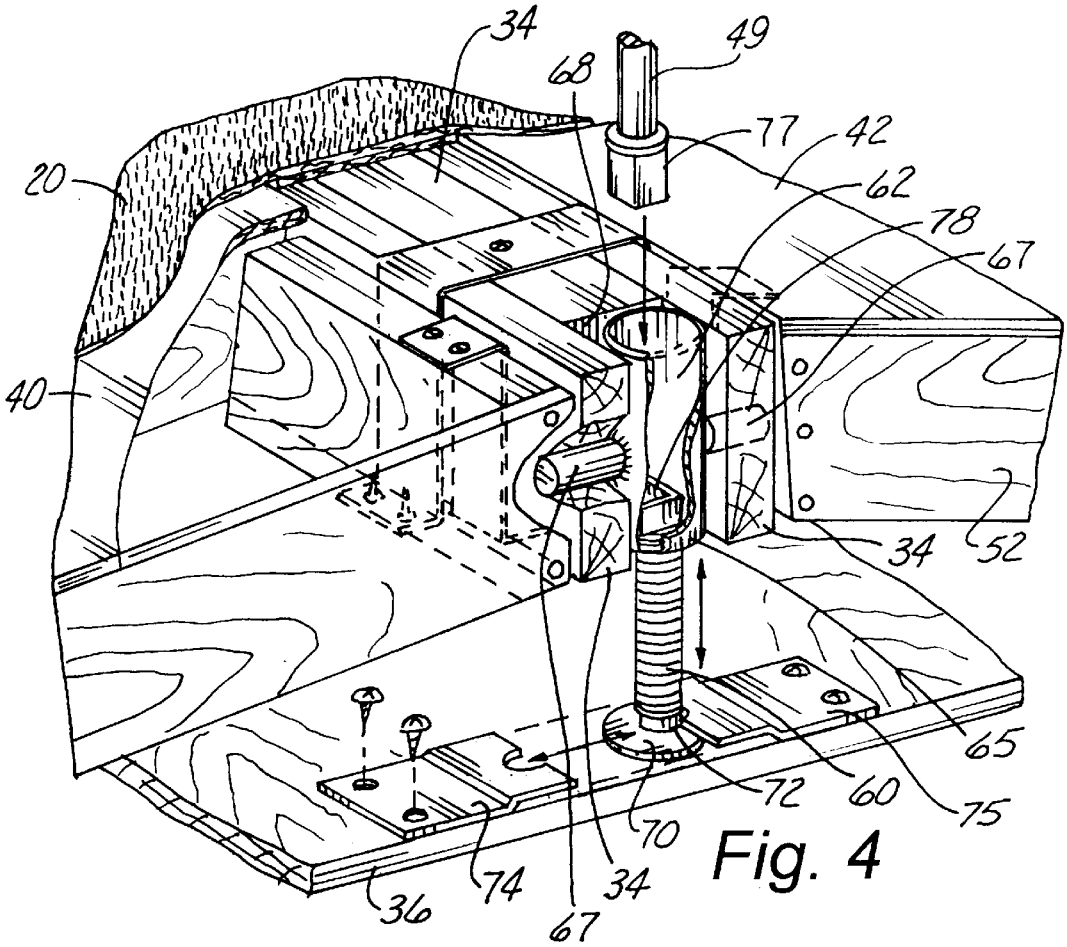
FIG. 4 is a partial perspective view of the adjustment mechanism built in accordance with the present invention.

Referring to FIG. 4, a detailed view of adjustment mechanism is shown. The adjustment mechanism is a screw jack comprised of a threaded shaft (60) and receiving portion (62). The receiving portion (62) includes an internally threaded portion (65) for matingly receiving the threaded shaft (60).

The receiving portion (62) includes two pins (67) which connect the receiving portion (62) to the center member (34). The two pins (67) engage two holes in the center member (34). As can be seen, the center member (34) includes a notch (68) at its end to allow room for the receiving portion (62). Connection of the receiving portion (62) to the center member (34) via the pins (67) and holes permits the receiving portion (62) to pivot about the center axis of the pins (67) with respect to the center member (34) as the center member (34) is adjusted up and down. The notch (68) is sufficient in size to permit the full range of pivoting required during the adjustment.

The threaded shaft (60) includes a disc (70) at the base (36) end. The threaded shaft also includes a non-threaded portion (72) positioned between the disc (70) and the threaded portion of the shaft (60). The disc (70) is held in place with respect to the base (36) by a bracket comprising two opposing plates (74 and 75). Each plate (74 and 75) includes an opening (77).

When the plates (74 and 75) are in position, the plates overlap the disc (70) and the openings form a hole which encircles the non-threaded portion (72) of the shaft (60). The plates (74 and 75) are fastened to the base (36) utilizing a suitable fastening mechanism such as screws.

This configuration provides for the shaft (60) and disc (70) to remain in a stationary position with respect to the base (36) while still being able to rotate about its center axis.

Furthermore, the configuration permits the shaft (60) to slightly tilt back and forth along the longitudinal axis of the center member (34) as the height of the center member (34) is adjusted. In the embodiment shown, the plates (74 and 75) are shown butting up next to one another. In another embodiment, the plates are configured such that they overlap one another. The overlap configuration still provides for the formation of a hole which encircles the non-threaded portion of the shaft and which functions essentially the same as the plates discussed above.

The center member (34) is adjusted upwardly and downwardly utilizing a crank (49). The crank (49) is inserted into the receiving portion (62) of the adjustment mechanism wherein the drive portion (77) of the crank (49) engages a receptacle (78) connected to the end of the shaft (60). As the crank (49) is rotated, the shaft (60) is likewise rotated. Since the threaded portion of the shaft engages the internally threaded portion (65) of the receiving portion (62), and since the receiving portion (62) is not free to rotate about its center axis due to the engagement of the pins (67) with the center member (34), the rotation of the crank (49) causes the center member to raise and lower.

Figure 5:
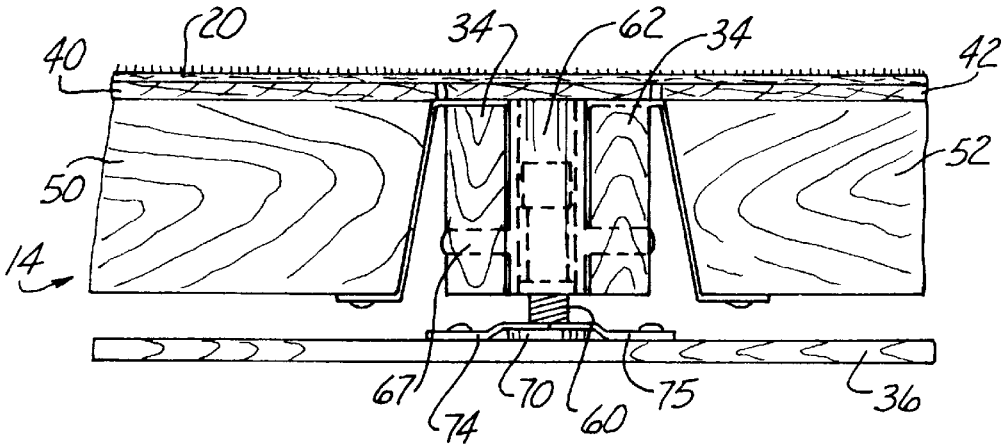
FIG. 5 is a partial side view of center portion of an adjustable module.

As can be seen in FIG. 5, the configuration of the lifting mechanism can be constructed to permit the lowering of the center member such that a depression or valley is created on the putting surface. Stops can be positioned on the shaft (75) to limit the upward and downward motion of the receiving portion (62) and thus the center member (34).

Substantial stability of the putting surface is realized by this design. By anchoring the shaft (60) to the base (36) and by utilizing a threaded engagement, the vertical position of the center member is maintained. Adjustable systems which are only anchored at one end result in a putting surface which can bounce.

Figure 6:
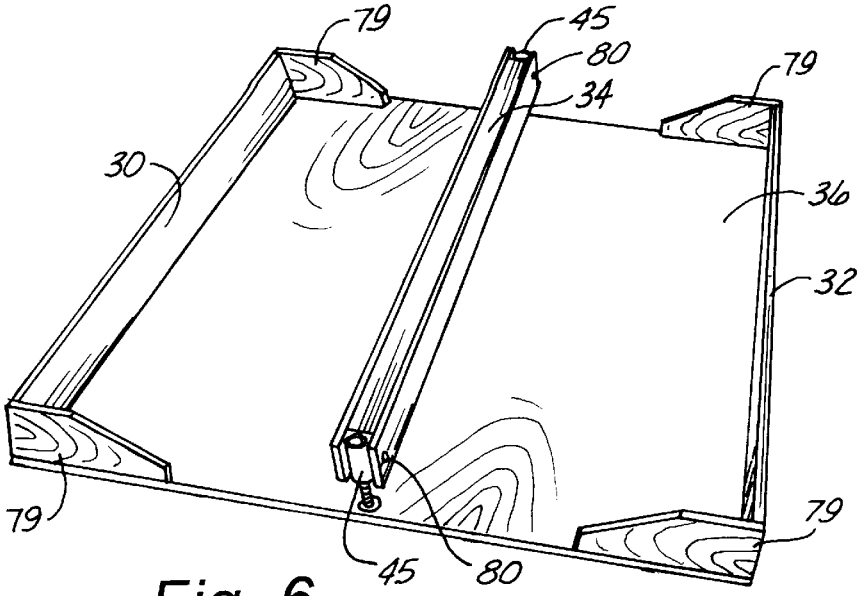
FIG. 6 is a partial perspective view of the frame, end members and center member of the adjustable putting surface module.

Referring to FIG. 6, the base (36) of a module of the putting surface of the present invention is shown. Attached to one end of the base (36) is an end member (30). Attached to the other end of the base is another end member (32). Each end member (30 and 32) include side supports (79). The side supports (79) operate to promote stability of the end pieces (30 and 32) with respect to the base (36). The preferred construction material for assembly of the module is primarily plywood and pine boards, although a variety of other materials could be utilized.

Spanning the middle of the base (36) is the center member (34). The center member (34) is shown with a connection mechanism (45), in this case screw jacks as described above, at each end. In this embodiment, the center member (34) is comprised of three pieces. A middle piece is sandwiched between two side pieces. As can be seen, the side pieces are longer than the middle pieces thereby creating a notch (68) at each end. The connection mechanisms (45) are disposed in the notch. Each of the end pieces include holes (80) for receiving the pins (67) of the connecting mechanisms (45). With the connecting mechanisms (45) in place, the three pieces comprising the center member are fastened together utilizing any suitable method, for example screws or glue, which is known in the art.

Figure 7:
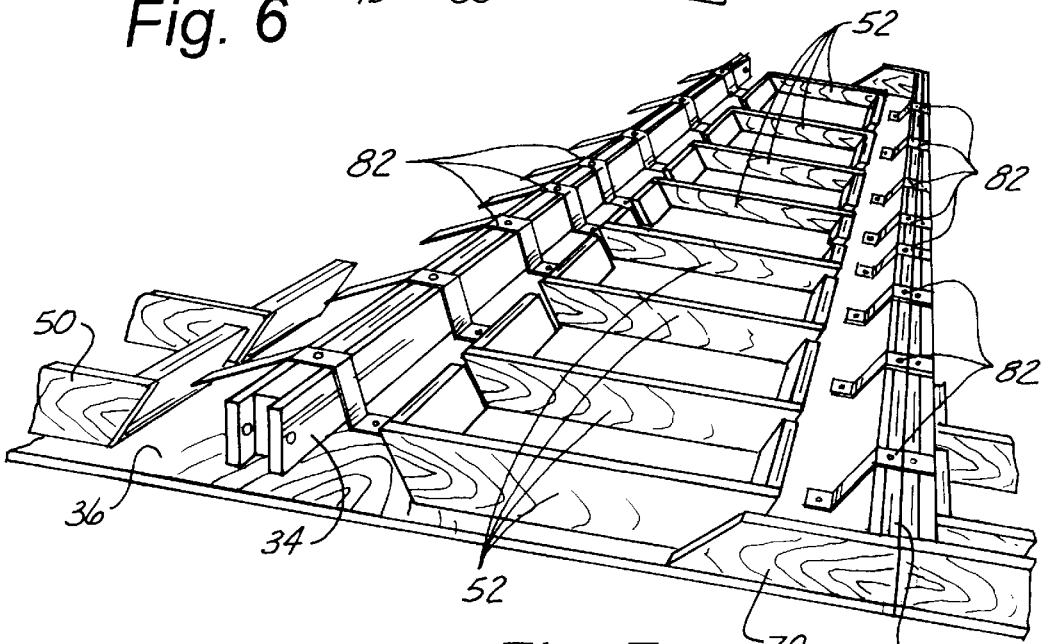
FIG. 7 is a partially exploded perspective view of the frame, end members, center member, connectors and independent support members of the adjustable putting surface module.

Referring now to FIG. 7, a partial exploded view of the module is shown with the a series of support members (52) and connectors (82). Each support member (52) is independent of the other support members (52) and is fastened independently to the end member (32) via connectors (82). In a preferred embodiment, the support members (52) are U-shaped as shown. The top of the U-shaped member faces inward with respect to the edge of the base (36). The two center support members (52) are approximately half as wide, as shown, to prevent too wide of a gap between the long portions of the support members (52).

The support members (52) provide additional support for the surface member (42, shown in FIG. 2). In this configuration, the surface members are connected to the support members and not directly to the end and center members. In other words, the connection of the surface members to the end and center members are accomplished via the support members.

The surface members are also made out of plywood in a preferred embodiment. Plywood offers the characteristic of being sufficiently rigid to support the weight of humans while still including a sufficient ability to twist, bend and flex. Obviously other materials could be used in accordance with the present invention. The use of independent support members (52) and a surface member (42) with the characteristic described above allow for the formation of complex curves as the two ends of the center member (34) are adjusted to various heights.

Additionally, as can be seen clearly in FIG. 7, the shape of the support members (52) are tapered. The top of the support member is longer than the bottom. The top is of sufficient length to effectively span the distance between the end member (32) and the center member (34) when the top of the center member (34) is level with the top of the end member (32). The bottom of the support member (52) is sufficiently shorter to prevent binding on one end or the other when the center member is raised or lowered.

The connectors (82) used to connect the support members (52) to the end member (32) and the center member (34) are of a flexible or double hinge nature. Utilizing either a flexible or double hinge type of connector permits a sufficient amount of expansion and contraction as the center member is raised or lowered. In a preferred embodiment, the connectors (82) comprise a metal strap. The metal strap is selected to be sufficiently pliable to permit the dual hinge characteristic thereby permitting the expansion and contraction. The use of a metal strap provides for additional stability as well. The use of a fabric strap, such as a durable nylon, would also work though it would not add as much stability as would a metal strap. A true double hinge, i.e. one utilizing pin hinges, would work as well. Obviously, a variety of connectors could be utilized in accordance with the present invention.

Figure 8:
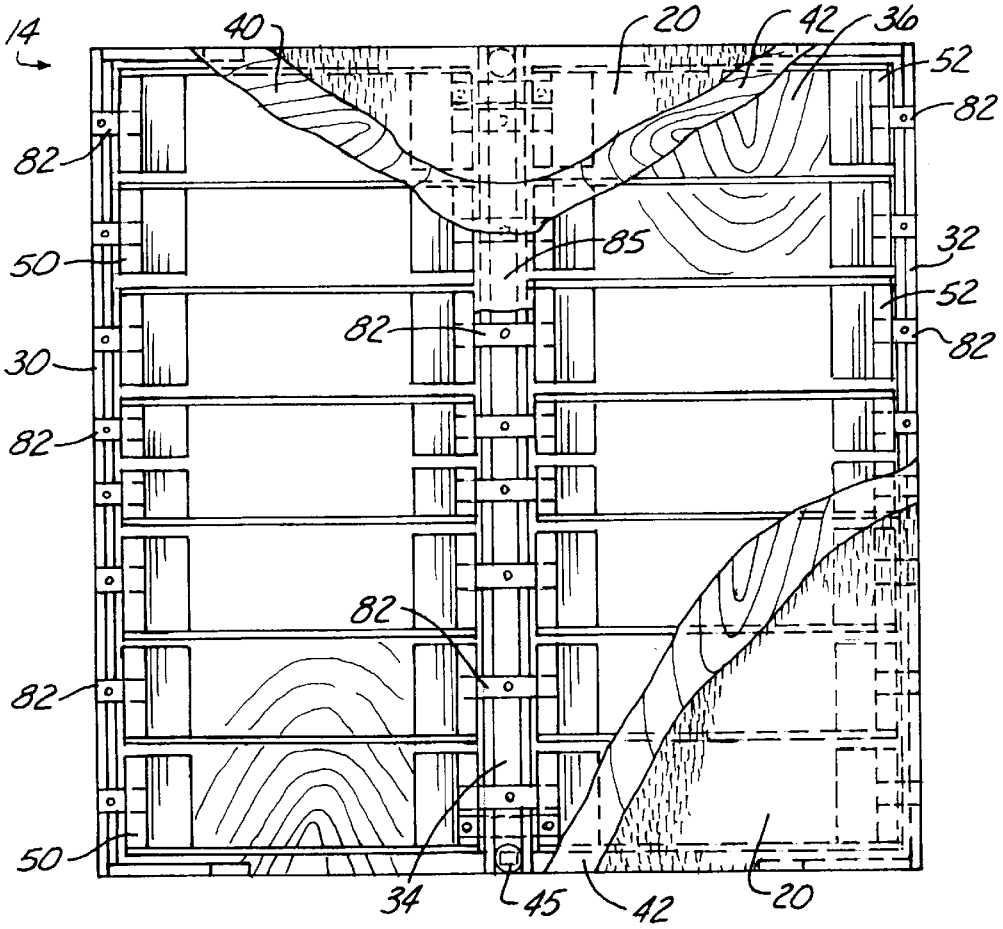
FIG. 8 is a partial top view of an adjustable putting surface module built in accordance with the present invention.

Referring now to FIG. 8, a partial top view of a section or module (14) is shown exposing the various components. Especially apparent in this view is the reduced width support members (50 and 52) in the middle portion of the module. Support members (52) operate and are connected in an identical fashion as support member (52) discussed above.

Figure 9:
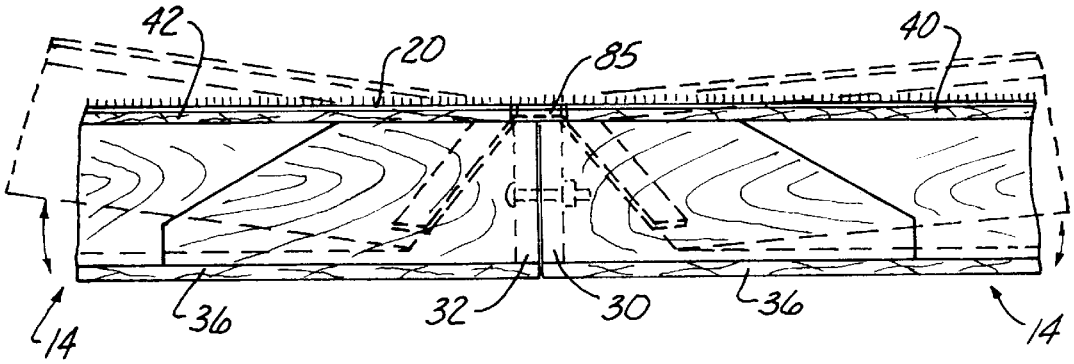
FIG. 9. is a partial side view of two adjustable putting surface module connected together at their ends.

Referring to FIG. 9, a side view of two modules (14) placed end to end is shown. The surface is shown in a flat or level position with the dashed lines representing raised positions. As can be seen, on side is raised higher than the other side. The two modules are shown bolted together which is the preferred method of connection. Connection of two module side by side can be accomplished using a bolt through the side supports (79).

Still referring to FIG. 9, a top cap (85) is shown. The top cap (85) is placed on top of the end members butted next to one another. The top cap (85) raises the height of the end members even with the surface members. Referring to FIG. 4, a similar top cap (85) is used to even the height of the center member (34) to that of the surface members (40 and 42). The top cap (85) also serve to cover the connectors (82) providing for a smoother surface.

In an alternative embodiment, top caps are not utilized. In this embodiment, the surface members are positioned so as to be even with the end members and the center member. This embodiment works especially well if the connectors are of a sufficiently low profile as to not create a deformity on the surface or if the connectors are recessed or connected to the sides of the end members and center member.

In still another embodiment, the end cap overlapping two adjacent end member is utilized as the connection mechanism between two sections positioned end-to-end. In still another embodiment, the end cap can be offset laterally whereby the end cap overlaps one half of two adjacent end member of a first set of two sections positioned end-to-end and overlaps one half of two adjacent end member of a second set of two sections positioned end-to-end. This last embodiment is utilized to not only connect end-to-end sections but to connect side-by-side sections as well. These embodiments can be used to replace alternative methods of connection, such as bolts, or in addition to the alternative connection method.

Figure 10:
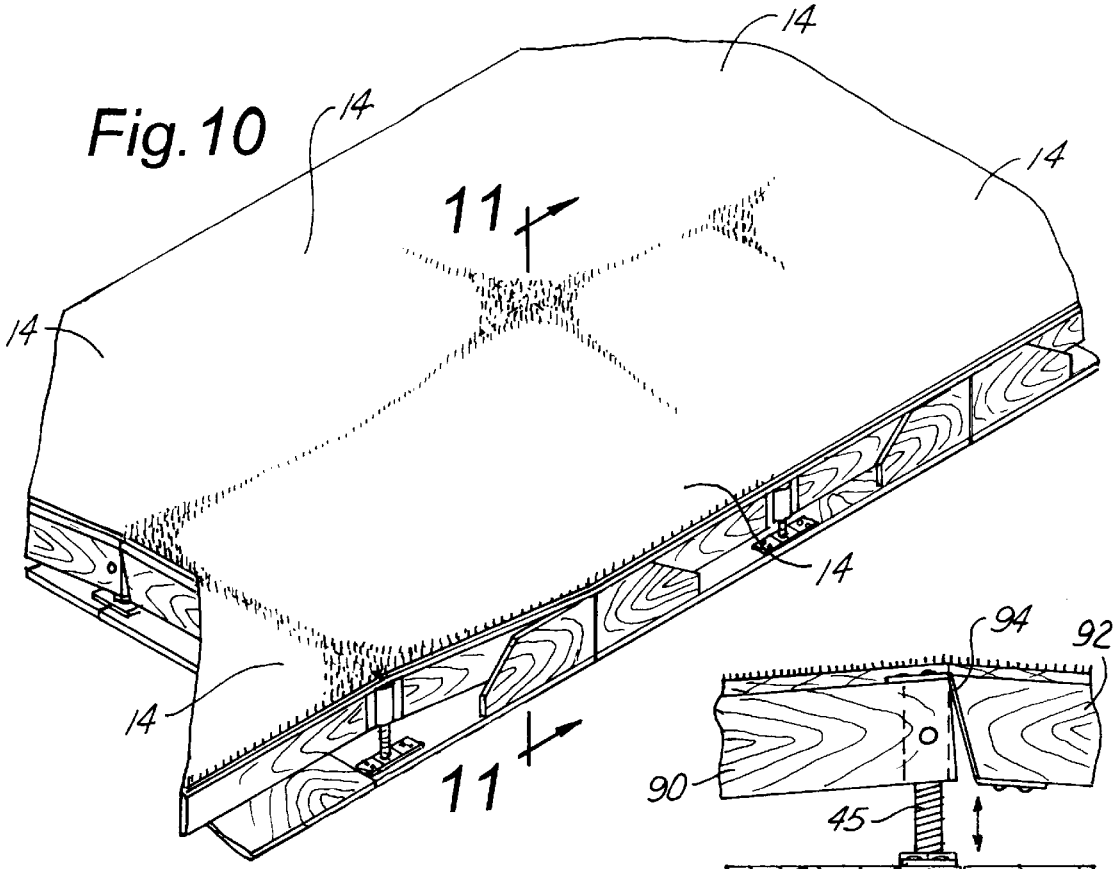
FIG. 10 is a partial perspective view of several modules built in accordance with the present invention connected together.

Referring now to FIG. 10, a series of connected modules (14) is shown. As can be seen, a very large surface can be created by placing modules (14) end-to-end and side-by-side. In some implementations of the present invention, it may be desirous for an overall shape which cannot be accomplished utilizing rectangular sections. In this situation, custom edge sections can be created and attached to the modules (14) in a similar manner as described above. Utilizing the custom edge sections, a putting surface of virtually any size and shape can be created.

In another embodiment of the present invention, the side edge of a particular section may be positioned up against a wall or other similar surface. In this embodiment, the connecting mechanism on the wall side of the center member can be replaced with a mounting bracket connected directly to the wall. The mounting bracket holding the wall end of the center member is adapted to permit a sufficient amount pivoting motion such that the opposite end of the center member can be raised and lowered. Obviously, when positioning a section adjacent to a wall, it is not mandatory that the mounting bracket be used in place the connecting mechanisms discussed above.

When two modules are positioned and connected side-by-side, two adjacent center member are positioned end to end. In this configuration it is preferable, though not required, that the two be connected in order to maintain a continuous surface without deformities. If the two center members are not connected, then each needs its own lifting or connection mechanism. However, if appropriately connected, there need only be one lifting or connecting mechanism.

Figure 11:
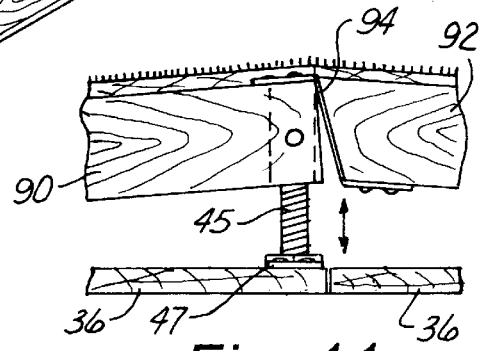
FIG. 11 is a partial side view of two adjacent center members being controlled by a single lifting mechanism.
Figure 12:
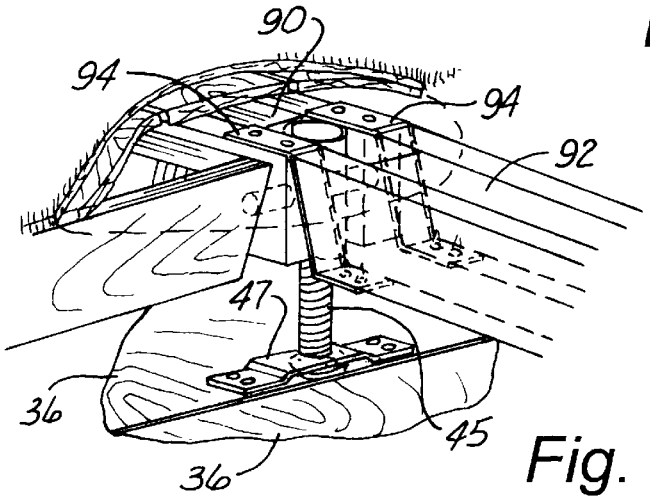
FIG. 12 is a partial perspective view of two adjacent center members being controlled by a single lifting mechanism.

Referring to FIGS. 11 and 12, the side by side connection of two modules (14) is shown in a preferred embodiment of the present invention. A first center member (90) is shown end-to-end with a second center member (92). The first center member (90) is shown with a lifting mechanism (45). The lifting mechanism (45) is connected to the base (36) utilizing a bracket (47). This configuration is identical in operation as in the embodiment discussed above. The second center member (92) does not include a lifting mechanism. Instead, it is connected to the first center member (90) via two connectors (94). The connectors (94) are essentially the same as the connectors (82) discussed above and allow for expansion and contraction. The end of the second center member (92) is tapered to prevent binding. By placing the connectors (94) on the top of the first center member (90) and on the bottom of the second center member (92), appropriate lifting force is transferred to the second center member (92) while still maintaining a connector capable of accommodating expansion.

Obviously many modifications and variations of the present invention are possible in light of the above teachings. It is therefore to be understood that, within the scope of the appended claims, the invention may be practiced otherwise than as specifically described.

I claim:

1. A modular putting surface apparatus, comprising:

a frame, said frame including a first end member positioned at one end of said frame and a second end member positioned at an other end of said frame;

a center member positioned between said first end member and said second end member;

a first surface member, said first surface member directly connected at one end to said first end member and directly connected at the other end to said center member;

a second surface member, said second surface member directly connected at one end to said second end member and directly connected at the other end to said center member;

a first connection mechanism, said first connection mechanism connecting one end of said center member to said frame;

a second connection mechanism, said second connection mechanism connecting an other end of said center member to said frame;

wherein said first connection mechanism includes lifting means for selectively raising and lowering said one end of said center member; and cover material positioned over the top of said first end member, said second end member, said center member, said first surface member and said second surface member.

2. The modular putting surface apparatus of claim 1 wherein said second connection mechanism includes lifting means for selectively raising and lowering said other end of said center member.

3. The modular putting surface apparatus of claim 1 wherein said lifting means comprises a screw jack and wherein said screw jack is accessible for adjustment through a hole in a top portion of the apparatus.

4. The modular putting surface apparatus of claim 1:

wherein said first surface member is directly connected to said first end member utilizing a plurality of connectors;

wherein said first surface member is directly connected to said center member utilizing a plurality of connectors;

wherein said second surface member is directly connected to said second end member utilizing a plurality of connectors; and wherein said second surface member is directly connected to said center member utilizing a plurality of connectors.

5. The modular putting surface apparatus of claim 4 wherein each plurality of connectors comprises a plurality of double hinges.

6. The modular putting surface apparatus of claim 4 wherein each plurality of connectors comprises a plurality of flexible straps.

7. The modular putting surface apparatus of claim 6 wherein said flexible straps are made of metal.

8. The modular putting surface apparatus of claim 1 wherein each of said first surface member and said second surface member comprises:

a flat surface portion; and a series of independent support members.

9. The modular putting surface apparatus of claim 8 wherein said independent support members are tapered from top to bottom to prevent interference with said first and second end members and said center member while said center member is raised and lowered.

10. The modular putting surface apparatus of claim 1 wherein said cover material is selected for its putting qualities to simulate putting on grass.

11. The modular putting surface apparatus of claim 1 including a hole in said second surface member with a cup inserted therein.

12. The modular putting surface apparatus of claim 1 including a series of holes in said first and said second surface members with a cup inserted into one of said holes and a plug inserted into the other holes, said plug being covered in the same cover material covering said first end member, said second end member, said center member, said first surface member and said second surface member.

* * * * *